US011782374B2

(12) United States Patent
Tsunoda

(10) Patent No.: US 11,782,374 B2
(45) Date of Patent: Oct. 10, 2023

(54) POST-PROCESSING APPARATUS AND IMAGE FORMING SYSTEM

(71) Applicant: KONICA MINOLTA, INC., Tokyo (JP)

(72) Inventor: Akira Tsunoda, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 83 days.

(21) Appl. No.: 16/663,864

(22) Filed: Oct. 25, 2019

(65) Prior Publication Data

US 2020/0133186 A1 Apr. 30, 2020

(30) Foreign Application Priority Data

Oct. 31, 2018 (JP) ..... 2018-205706

(51) Int. Cl.
*G03G 15/00* (2006.01)
*G03G 15/23* (2006.01)

(52) U.S. Cl.
CPC ..... *G03G 15/6573* (2013.01); *G03G 15/234* (2013.01); *G03G 15/6523* (2013.01); *G03G 2215/00421* (2013.01); *G03G 2215/00438* (2013.01)

(58) Field of Classification Search
CPC ..... G03G 15/234; G03G 15/6523; G03G 15/6573; G03G 2215/00421; G03G 2215/00438
See application file for complete search history.

(56) References Cited

U.S. PATENT DOCUMENTS 5,709,376 A 1/1998 Ushirogata
6,782,236 B2 * 8/2004 Sasaki ..... G03G 15/234 271/184
7,946,582 B2 * 5/2011 Suh ..... G03G 15/6573 271/302
9,086,668 B2 * 7/2015 Nakamura ..... G03G 15/6582
(Continued)

FOREIGN PATENT DOCUMENTS

CN 102020141 A 4/2011
CN 107031209 A 8/2017
(Continued)

OTHER PUBLICATIONS

First Office Action dated Dec. 22, 2021, by the State Intellectual Property Office of the People's Republic of China in corresponding Chinese Patent Application No. 201911043789.8 and an English translation of the Action. (11 pages).
(Continued)

*Primary Examiner* — Justin N Olamit
(74) *Attorney, Agent, or Firm* — BUCHANAN INGERSOLL & ROONEY PC

(57) ABSTRACT

Disclosed is a post-processing apparatus configured to be coupled to an image forming apparatus or another post-processing apparatus. The post-processing apparatus includes: a post-processing unit that performs post-processing to a sheet that is conveyed; and a standby path arranged on an upstream side or a downstream side of the post-processing unit and capable of holding the sheet. The post-processing unit performs the post-processing in a state in which the sheet is partly in the standby path.

12 Claims, 6 Drawing Sheets

(56) References Cited

U.S. PATENT DOCUMENTS

| | | | | |
|---|---|---|---|---|
| 9,365,069 | B2 * | 6/2016 | Kawai | B42C 7/005 |
| 9,676,585 | B2 * | 6/2017 | Kiriyama | B26D 7/2635 |
| 2011/0058875 | A1 * | 3/2011 | Kobayashi | G03G 15/6582 399/407 |
| 2017/0219984 | A1 * | 8/2017 | Kitamura | B65H 29/60 |

FOREIGN PATENT DOCUMENTS

| | | | |
|---|---|---|---|
| JP | S52-50740 | U | 4/1977 |
| JP | H09-202507 | A | 8/1997 |
| JP | 2010188607 | A | 9/2010 |
| JP | 2014-35510 | A | 2/2014 |
| JP | 2017-137167 | A | 8/2017 |

OTHER PUBLICATIONS

Notice of Reasons for Refusal dated Jul. 19, 2022, by the Japanese Patent Office in corresponding Japanese Patent Application No. 2018-205706 and an English translation of the Notice. (11 pages).

* cited by examiner

POST-PROCESSING APPARATUS AND IMAGE FORMING SYSTEM

CROSS-REFERENCE TO RELATED APPLICATION

This application is based upon and claims the benefit of priority from the prior Japanese Patent Application No. 2018-205706, filed on Oct. 31, 2018, the entire contents of which are incorporated herein by reference.

BACKGROUND

Technological Field

The present invention relates to a post-processing apparatus and an image forming system equipped with the post-processing apparatus.

Background Art

Post-processing apparatuses are conventionally known in the art that performs various kinds of post-processing to a sheet after an image is formed thereon by an image forming apparatus. For example, a post-processing apparatus that performs post-processing to one sheet in an offline state is known in the art.

The post-processing that is performed by the offline post-processing apparatus may be cross-direction (CD) cutting. In this case, the feed-direction (FD) length (the length of a sheet in the conveyance-direction) is shortened as a result of the cutting, and therefore, the arrangement of subsequent conveyance rollers should be dense. In view of this, a cross-direction cutting unit for cutting in a cross direction is arranged on the most downstream side. In the case of a post-processing apparatus 201 having a cross-direction cutting unit U1 that is arranged on the most downstream side, as shown in FIG. 8, a trailing end (rear end) of a sheet P is cut in the cross direction in a state in which a main body of the sheet P goes out of the apparatus body. That is, an offline post-processing apparatus performs post-processing in the state in which a leading end (front end) or a trailing end of a sheet is partly out of the apparatus body.

Another example of a known post-processing apparatus performs punching to a sheet. To perform the punching to a sheet, image forming to a sheet is controlled in accordance with the type of the punch processor and the presence/absence of an inverter. This enables performing punching to a desired position and ejecting sheets so that the sheets will be stacked in the page order. One example is disclosed in JP 2010-188607A.

In a case of an inline post-processing apparatus 202, the post-processing apparatus 202 is arranged between other apparatuses such as an image forming apparatus 101, a relay unit RU, and a finisher FS. In this condition, a sheet P is laid across the post-processing apparatus 202 and the other apparatus on the upstream side or the downstream side thereof. As shown in FIG. 9, the sheet P may be laid across the post-processing apparatus 202 and a finisher FS on the downstream side. Thus, it is necessary to control such as to match the conveyance speed between the post-processing apparatus 202 and the apparatus on the upstream or downstream side and to stop the sheet P, depending on the post-processing performed by a post-processing unit. For example, the post-processing unit is a cross-direction cutting unit U1. Moreover, various post-processing apparatuses such as a large stacker (LS), a saddle stitcher (SD), and a finisher (FS), are further coupled on the upstream and downstream sides, which increases such controlling works and makes it difficult to control each of the post-processing apparatuses.

According to the technique disclosed in JP 2010-188607A, the image forming is controlled in accordance with the combination of the apparatuses that are used after the image forming. However, in the case of performing post-processing in the state in which the main body of a sheet is out of the apparatus body as in cross-direction cutting, the sheet is still laid across the post-processing apparatus and the other apparatus on the upstream side or the downstream side. Thus, it is still necessary to link control of the post-processing apparatus with controls of the apparatuses on the upstream and downstream sides.

SUMMARY

The present invention has been achieved in view of the above-described problems, and an object thereof is to provide a post-processing apparatus that performs inline post-processing without affecting apparatuses on the upstream and downstream sides.

To achieve at least one of the abovementioned objects, according to an aspect of the present invention, a post-processing apparatus reflecting one aspect of the present invention, the post-processing apparatus configured to be coupled to an image forming apparatus or another post-processing apparatus, the post-processing apparatus, comprises:

- a post-processing unit that performs post-processing to a sheet that is conveyed; and
- a standby path arranged on an upstream side or a downstream side of the post-processing unit and capable of holding the sheet,
- wherein the post-processing unit performs the post-processing in a state in which the sheet is partly in the standby path.

According to another aspect of the present invention, an image forming system reflecting one aspect of the present invention, comprises:

- an image forming apparatus that forms an image on a sheet; and
- the above-described post-processing apparatus that performs the post-processing to the sheet on which the image is formed by the image forming apparatus.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DESCRIPTION OF EMBODIMENTS

Hereinafter, an embodiment of the present invention will be described in detail with reference to the drawings.

Figure 1:
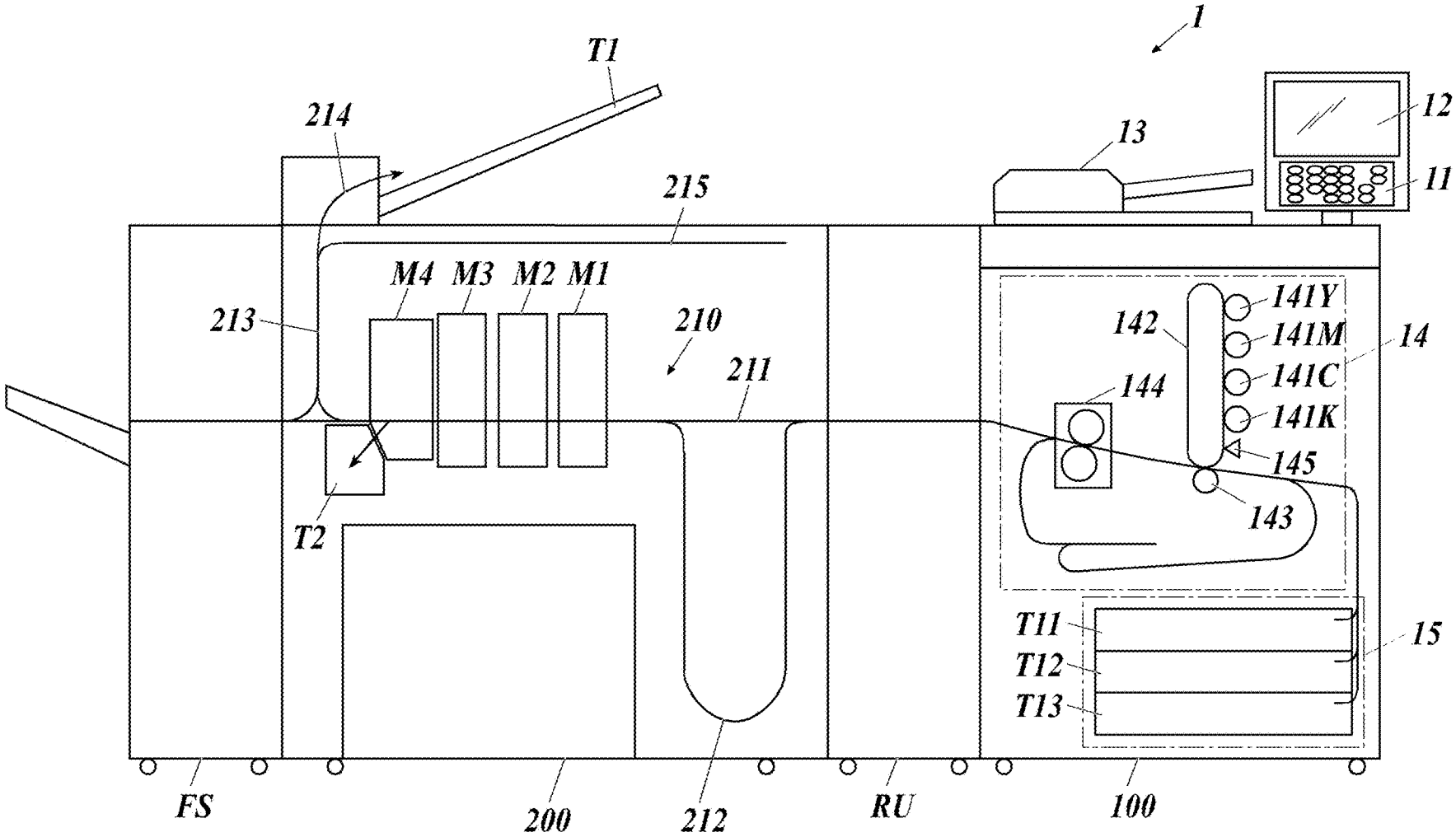
FIG. 1 shows an outline of a configuration of an image forming system according to an embodiment of the present invention.
Figure 2:
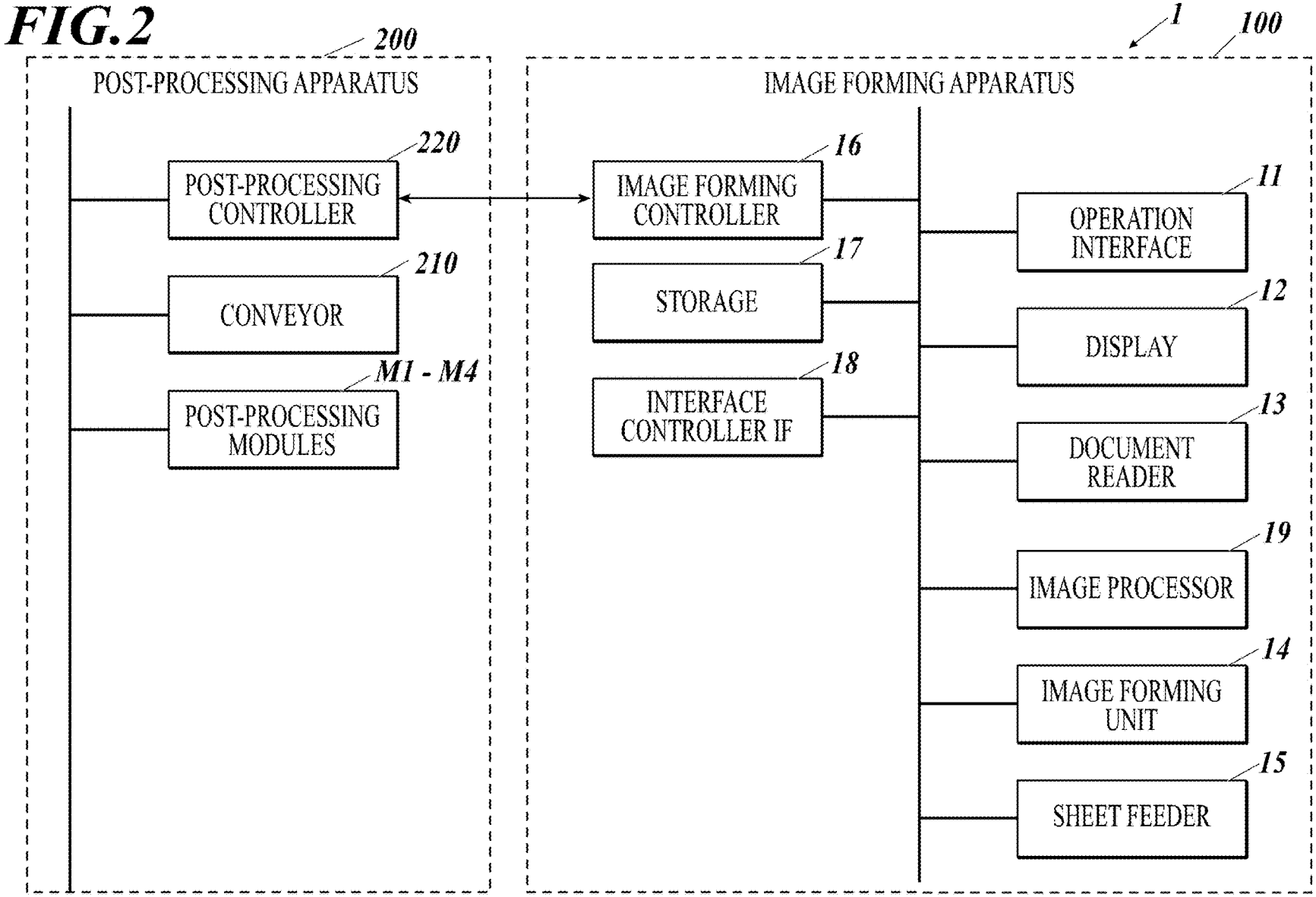
FIG. 2 is a functional block diagram showing a control configuration of the image forming system according to the embodiment of the present invention.

As shown in FIG. 1 or 2, an image forming system 1 according to this embodiment includes an image forming apparatus 100, a relay unit RU, a post-processing apparatus 200, and a finisher FS. In this embodiment, the post-processing apparatus 200 corresponds to the "post-processing apparatus" of the present invention, and the relay unit RU and the finisher FS correspond to the "other post-processing apparatuses" of the present invention.

The image forming apparatus 100 electrophotographically forms a color image on the basis of image data obtained by reading an image from a document or image data received from an external apparatus.

As shown in FIG. 1 or 2, the image forming apparatus 100 includes an operation interface 11, a display 12, a document reader 13, an image forming unit 14, a sheet feeder 15, an image forming controller 16, a storage 17, an interface controller IF 18, and an image processor 19.

The operation interface 11 includes a touch panel that is formed to cover a display screen of the display 12 and also includes various operation buttons, such as a numeric keypad and a start button. The operation interface 11 outputs an operation signal based on a user operation, to the image forming controller 16.

The display 12, which is constituted by a liquid crystal display (LCD), displays various screens in accordance with a display signal input from the image forming controller 16.

The document reader 13 includes an automatic document feeder (ADF), a scanner, and other components. The document reading unit 13 reads an image from a document and outputs this image data to the image forming controller 16.

The image forming unit 14 forms an image on a sheet supplied from the sheet feeder 15, on the basis of the image data that is image-processed by the image processor 19.

The image forming unit 14 includes photoreceptor drums 141Y, 141M, 141C, and 141K respectively corresponding to colors of yellow (Y), magenta (M), cyan (C), and black (K), an intermediate transfer belt 142, a secondary transfer roller 143, a fixing unit 144, a density sensor 145, and other components.

After being uniformly charged, the photoreceptor drum 141Y is exposed by being scanned with a laser beam, on the basis of image data of yellow color, so that an electrostatic latent image is formed. Thereafter, yellow color toner is allowed to adhere to the electrostatic latent image on the photoreceptor drum 141Y, whereby the electrostatic latent image is developed.

The functions of the photoreceptor drums 141M, 141C, and 141K are similar to that of the photoreceptor drum 141Y except for the target colors, and therefore, descriptions thereof are omitted.

The toner image in each color formed on the corresponding photoreceptor drum 141Y, 141M, 141C, or 141K is successively transferred onto the rotating intermediate transfer belt 142 (primary transfer). That is, the toner images in the four colors are overlaid on each other to form a color toner image on the intermediate transfer belt 142.

The color toner image on the intermediate transfer belt 142 is collectively transferred onto a sheet by the secondary transfer roller 143 (a secondary transfer).

The fixing unit 144 includes a heating roller for heating the sheet on which the color toner image is transferred and also includes a pressure roller for pressing this sheet. The fixing unit 144 fixes the color toner image on the sheet by heat and pressure.

The sheet feeder 15 includes sheet feeding trays T11 to T13 and supplies a sheet to the image forming unit 14. Each of the sheet feeding trays T11 to T13 contains sheets of predetermined paper type and size.

The image forming controller 16 includes a CPU, a ROM, and a memory.

The CPU reads various kinds of processing programs stored in the ROM and centralizedly controls the operation of each component of the image forming apparatus 100 in accordance with the read processing programs. The CPU outputs an instruction to execute predetermined post-processing, to the post-processing apparatus 200 in the case of performing post-processing to the sheet that is output.

The ROM, which is composed of a nonvolatile semiconductor memory and other components, stores information such as various kinds of processing programs, and parameters and files necessary to execute the processing programs.

The memory, which is composed of a dynamic random access memory (DRAM) and other components, temporarily stores various data such as programs and image data relating to various types of image processing.

The storage 17 is a nonvolatile storage device that stores various data, such as programs and image data, and is a hard disk drive (HDD), a semiconductor memory, or other device. The storage 17 stores data such as program data and various kinds of setting data in a readable and writable manner for the image forming controller 16.

The controller IF 18 receives image data input from an external apparatus.

The image processor 19 performs necessary image processing to the image data stored in the storage 17, the image data obtained by the document reader 13 reading an image from a document, and the image data input from an external apparatus. The image processor 19 then sends the image-processed image data to the image forming unit 14. The image processing involves gradation processing, halftone processing, and color conversion processing. The gradation processing is performed to convert a gray level of each pixel of image data into a corrected gray level so that the density characteristics of an image formed on a sheet will coincide with target density characteristics. The halftone processing includes error diffusion processing and screen processing using an ordered dithering method. The color conversion processing is performed to convert each gray level of RGB into a corresponding gray level of CMYK.

The relay unit RU is placed between the image forming apparatus 100 and the post-processing apparatus 200 to synchronize the conveyance speed of the sheet in the post-processing apparatus 200 with that of the sheet conveyed from the image forming apparatus 100.

The post-processing apparatus 200 performs post-processing to the sheet output from the relay unit RU, as necessary. Examples of the post-processing include slitting processing, gutter slitting processing, cross-direction cutting processing, crease processing, feed-direction perforating processing, and cross-direction perforating processing. The post-processing is not indispensable, and the post-processing apparatus 200 executes the post-processing only when instructed by the image forming apparatus 100. When no post-processing is performed, the post-processing apparatus 200 simply conveys the conveyed sheet to the finisher FS.

As shown in FIG. 1 or 2, the post-processing apparatus 200 includes a conveyor 210, post-processing modules M1 to M4 as post-processing units, a purge tray T1 to which a sheet to be purged is ejected from the post-processing apparatus 200, a card tray T2 to which a sheet that is cut into the size of a card, such as a business card, by the post-processing apparatus 200 is ejected, and a post-processing hardware processor 220.

The conveyor 210 conveys the sheet conveyed from the relay unit RU to the post-processing modules M1 to M4. The conveyor 210 then conveys the sheet post-processed by the post-processing modules M1 to M4, to the purge tray T1, the card tray T2, or the finisher FS.

The conveyor 210 includes a straight conveyance path 211, a long unit 212, an inversion and ejection path 213, a common path 214, and a long unit 215. The straight conveyance path 211 has a skew correction function of correcting skew of the sheet to be conveyed to the post-processing module M1. The long unit 212 has a cross-direction aligning function of aligning a long sheet to be conveyed to the post-processing module M1 in the cross direction or the sheet width direction, by forcing the long sheet to take a detour. The inversion and ejection path 213 is used to invert the sheet with, at most, a regular size after the sheet is post-processed by the post-processing modules M1 to M4, and the inverted sheet is then ejected to the finisher FS. The common path 214 serves as an ejection path for ejecting the sheet to the purge tray T1 and as an inversion path for inverting the sheet with, at most, a regular size. The long unit 215 serves as an inversion path for inverting the long sheet after the long sheet is post-processed by the post-processing modules M1 to M4.

That is, the inversion and ejection path 213, the common path 214, and the long unit 215 are arranged on the upstream side or downstream side of the post-processing modules M1 to M4 and function as standby paths of the present invention for holding a sheet. In this embodiment, since the post-processing units, in particular, the post-processing module M4, are arranged at the downstream part of the apparatus body, each of the standby paths, i.e. the inversion and ejection path 213, the common path 214, and the long unit 215, is arranged on the downstream side of the post-processing module M4.

The inversion and ejection path 213, the common path 214, and the long unit 215 function as an inversion path of the present invention for inverting a sheet.

The common path 214 functions as a purge path of the present invention for purging a sheet.

Moreover, the inversion and ejection path 213 and the common path 214 function as a regular-sheet inversion path for inverting a sheet with, at most, a regular size.

The long unit 215 also functions as a long-sheet inversion path for inverting a sheet with a long size exceeding the regular size.

The post-processing modules M1 to M4 performs post processing on the conveyed sheet. The post-processing modules M1 to M4 perform post-processing in the state in which a part of the sheet is in the standby path, i.e. the inversion and ejection path 213, the common path 214 or the long unit 215.

In this embodiment, the post-processing module M1 is provided on the most upstream side and is a vertical-direction slitter, and the post-processing module M4 is provided on the most downstream side and is a cross-direction cutter or a cross-direction cutting unit for cutting in the cross direction. The post-processing modules M2 and M3 are manually selectable by a service person. For example, each of the post-processing modules M2 and M3 is selected from among a gutter slitter, a creaser for downward projection, a creaser for upward projection, a feed-direction perforator, and a cross-direction perforator. The gutter slitter slits a gutter at a center part in the cross direction or the sheet width direction of a sheet. Each of the creasers for downward projection and for upward projection performs creasing processing for creasing a sheet. The feed-direction perforator performs feed-direction perforating processing for perforating a sheet. The cross-direction perforator performs cross-direction perforating processing for perforating a sheet.

The post-processing controller 220 includes a CPU, a ROM, and a memory.

The CPU reads various kinds of processing programs stored in the ROM and centralizedly controls movement of each component of the post-processing apparatus 200 in accordance with the read processing programs.

For example, the CPU communicates information with the image forming controller 16 of the image forming apparatus 100. The CPU functions as a hardware processor of the present invention that collates pages sheets when the inversion path, i.e. the inversion and ejection path 213, the common path 214, and/or the long unit 215, is used. Specifically, the CPU sends an instruction to correct page disorder due to inversion, to the image forming controller 16 of the image forming apparatus 100. In response to this, the image forming controller 16 performs correction control of the page order, thereby collating pages of the sheets.

The finisher FS has functions of such as stapling, folding, and punching a sheet after image formation.

As described above, the post-processing apparatus 200 of the image forming system 1 according to this embodiment includes: a post-processing unit, which is the post-processing modules M1 to M4; and the standby path, which is the inversion and ejection path 213, the common path 214, and the long unit 215. The post-processing unit performs post-processing to a conveyed sheet. The standby path is arranged on the upstream side or the downstream side of the post-processing unit and is capable of holding a sheet. The post-processing unit performs the post-processing in the state in which the sheet is partly in the standby path.

This post-processing apparatus 200 according to this embodiment does not require stopping or controlling the conveyance movements of other apparatuses that are coupled in an inline manner even when the post-processing apparatus 200 stops the conveyance for post-processing. The other apparatuses are the image forming apparatus 100 and the other post-processing apparatuses such as the relay unit RU and the finisher FS. Thus, post-processing is performed without affecting the apparatuses on the upstream and downstream sides.

In the post-processing apparatus 200 according to this embodiment, the post processing is any one of slitting processing, gutter slitting processing, cross-direction cutting processing, crease processing, feed-direction perforating processing, and cross-direction perforating processing.

That is, the post-processing apparatus 200 according to this embodiment performs various kinds of post-processing without affecting the apparatuses on the upstream and downstream sides. In particular, this is more effective in performing processing that requires stopping conveyance of a sheet, for example, cross-direction cutting processing, crease processing, or cross-direction perforating processing.

In the post-processing apparatus 200 according to this embodiment, the standby path is provided by the inversion path for inverting a sheet, which is the inversion and ejection path 213, the common path 214, and the long unit 215.

This structure of the post-processing apparatus 200 according to this embodiment enables narrowing the machine length, thereby suppressing the increase in dimensions of the apparatus. Since the inline post-processing apparatus 200 operates inline, the image forming apparatus 100 can control to correct page disorder. Thus, page disorder is accurately corrected even in the case of using the inversion path that changes the page order at the time of inversion.

In the post-processing apparatus 200 according to this embodiment has the inversion path that also serves as the purge path for purging a sheet, which is the common path 214.

That is, the post-processing apparatus 200 according to this embodiment makes use of other path, more specifically, the purge path, for the inversion path. This enables further reduction in the space for the inversion path to narrow the machine length, thereby further suppressing the increase in dimensions of the apparatus.

In the post-processing apparatus 200 according to this embodiment, the inversion path includes the regular-sheet inversion path, which is the inversion and ejection path 213 and the common path 214, and also includes the long-sheet inversion path, which is the long unit 215. The regular-sheet inversion path is used to invert a sheet with, at most, a regular size. The long-sheet inversion path is used to invert a long sheet with a size exceeding the regular size.

That is, the long-sheet inversion path for a long sheet with a long sheet length is separated from the regular-sheet inversion path for a regular sheet in the post-processing apparatus 200 according to this embodiment. This enables increasing the interval or pitch between conveyance rollers in the long-sheet inversion path, thereby simplifying the configuration of the apparatus. Regardless of the size of a sheet, the sheet does not partially go out of the apparatus body at the time of inversion, and a damage to the sheet at the time of inversion of the sheet is thereby prevented.

The post-processing apparatus 200 according to this embodiment includes the hardware processor that collates pages of sheets when the inversion path is used, which is the post-processing hardware processor 220.

With this configuration, the post-processing apparatus 200 according to this embodiment sends an instruction to correct page disorder caused by inversion to the image forming controller 16 of the image forming apparatus 100, so as to make the image forming controller 16 perform correction control of the page order. Thus, page disorder is accurately corrected even in the case where the inversion path is used so that the page order is changed at the time of inversion.

In the post-processing apparatus 200 according to this embodiment, the standby path is provided by the purge path for purging a sheet, which is the common path 214.

This structure of the post-processing apparatus 200 according to this embodiment enables narrowing the machine length, thereby suppressing increase in dimensions of the apparatus.

In the post-processing apparatus 200 according to this embodiment, the standby path is arranged on the downstream side of the post-processing unit in the case in which the post-processing unit is at the downstream part of the apparatus body.

This structure of the post-processing apparatus 200 according to this embodiment enables narrowing the machine length, thereby suppressing increase in dimensions of the apparatus. Moreover, even when the conveyance is stopped for post-processing in the post-processing apparatus 200, it is not necessary to stop or control the conveyance movements of other apparatuses that are coupled in an inline manner. The other apparatuses are the image forming apparatus 100 and the other post-processing apparatuses using the relay unit RU and the finisher FS. Thus, post-processing is performed without affecting the apparatuses on the upstream and downstream sides.

The above describes specific examples on the basis of the embodiment of the present invention, but the present invention is not limited to the foregoing embodiment and can be changed and modified without exceeding the scope of the present invention.

For example, while the above-described embodiment illustrates an example configuration in which the post-processing apparatus 200 of the present invention is coupled to the other post-processing apparatuses of the present invention, that is, the relay unit RU and the finisher FS, the configuration of the present invention is not limited thereto. In one example, the post-processing apparatus 200 may be coupled only to the relay unit RU, or the post-processing apparatus 200 may be coupled to the image forming apparatus 100 and the finisher FS. In another example, the post-processing apparatus 200 may be coupled only to the image forming apparatus 100.

Although the above-described embodiment illustrates an example in which the standby path 214 is composed of the inversion and ejection path 213, the common path 214, and the long unit 215, the present invention is not limited thereto.

Figure 3:
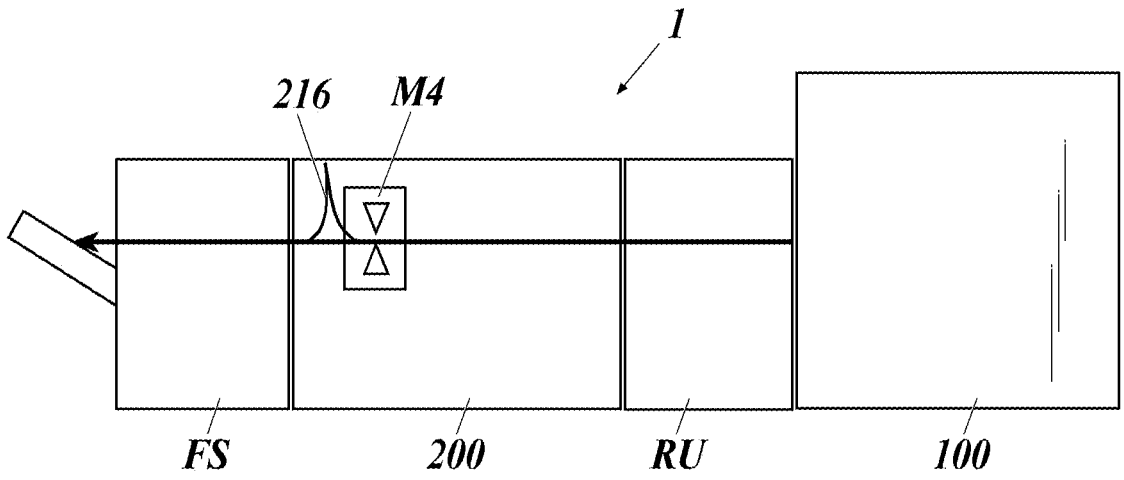
FIG. 3 shows a configuration in which an inversion path is arranged on a downstream side of a post-processing unit.

In one example, as shown in FIG. 3, only the inversion path 216 may be used as the standby path.

Figure 4:
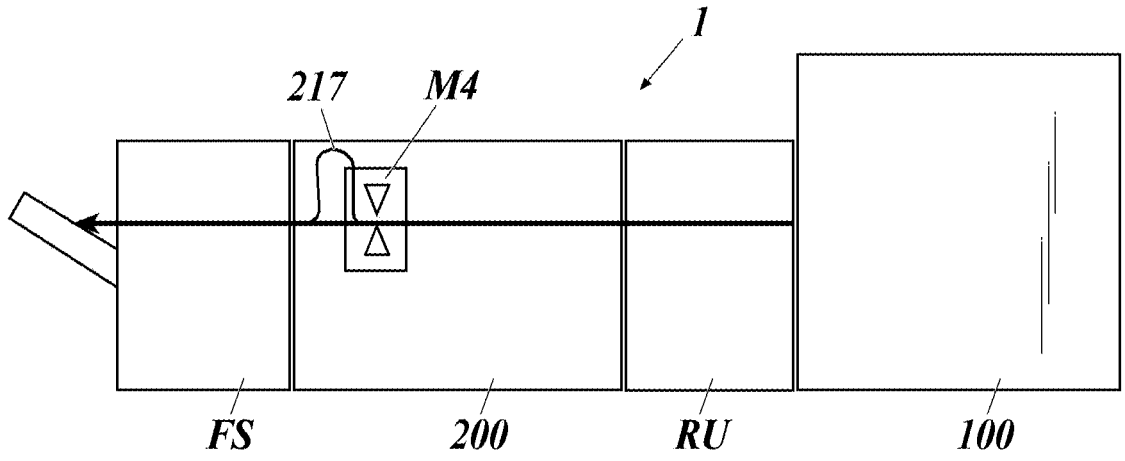
FIG. 4 shows a configuration in which a detour path is arranged on the downstream side of the post-processing unit.

In another example, as shown in FIG. 4, only the detour path 217 for making a sheet detour may be used as the standby path. This configuration of using the detour path 217 for making a sheet detour as the standby path enables narrowing the machine length, thereby suppressing the increase in dimensions of the apparatus.

Figure 5:
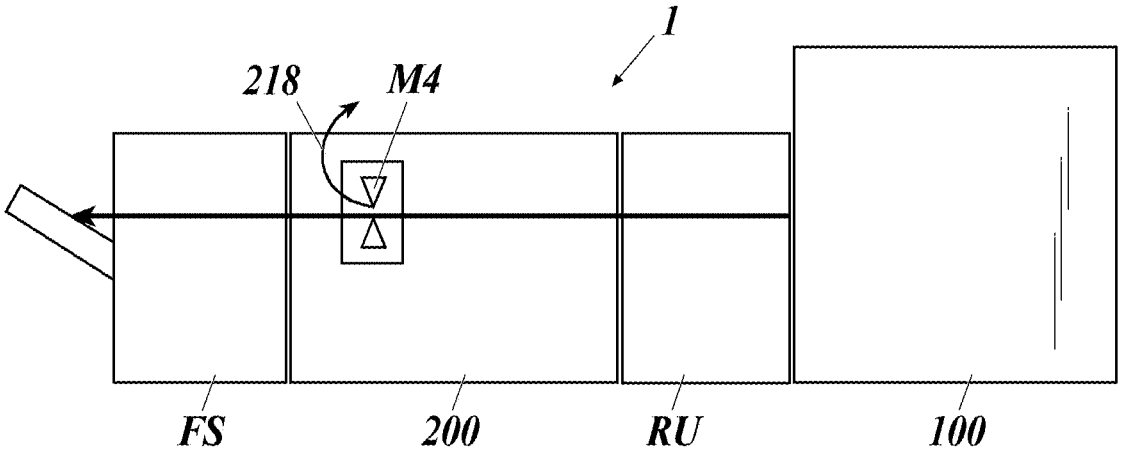
FIG. 5 shows a configuration in which a purge path is arranged on the downstream side of the post-processing unit.

In yet another example, as shown in FIG. 5, only the purge path 218 may be used as the standby path.

Figure 6:
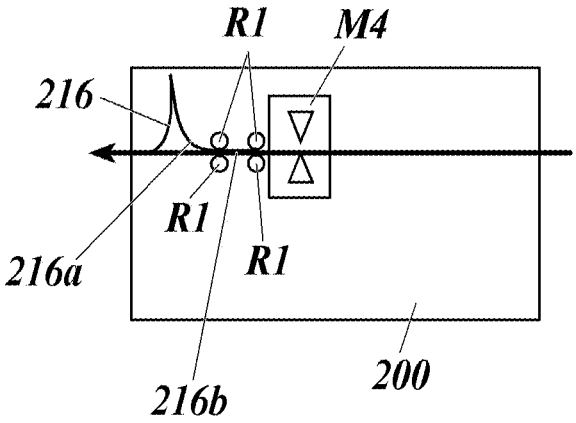
FIG. 6 shows a configuration in which a straight path is arranged between the post-processing unit and a curved path.

In the case in which a curved path 216*a* is provided in the inversion path 216 that serves as the standby path, as shown in FIG. 6, a straight path 216*b* may be disposed between the post-processing unit, or more specifically, the post-processing module M4, and the curved path 216*a*.

In this case, as shown in FIG. 6, a pressing member R1 for regulating vertical movement of a sheet may be arranged in the straight path 216*b*. Two pairs of conveyance rollers are arranged in the illustrated example. The pressing member R1 can be constituted by any member(s) that can at least suppress flapping of a sheet.

In the case in which the inversion path 216 has the curved path 216*a* in its passage as described above, the straight path 216*b* may be disposed between the post-processing unit and the curved path 216*a*. This arrangement suppresses flapping of a sheet and stabilizes the position of the sheet, thereby secures the accuracy of the post-processing.

The pressing member R1 for regulating vertical movement of a sheet, which is disposed in the straight path 216*b*, more reliably stabilizes the position of a sheet, thereby improving the accuracy of the post-processing.

In this embodiment, the standby path, which are the inversion and ejection path 213, the common path 214, and the long unit 215, is arranged on the downstream side of the post-processing module M4 since the post-processing unit, more specifically, the post-processing module M4, is arranged at the downstream part of the apparatus body. However, the present invention is not limited thereto. For example, in a case in which the post-processing unit is at the upstream part of the apparatus body, the standby path may be arranged on the upstream side of this post-processing unit.

In the case in which the post-processing unit is at the upstream part of the apparatus body as described above, the standby path is arranged on the upstream side of the post-processing unit to narrow the machine length, thereby suppressing increase in dimensions of the apparatus. In these conditions, even when the conveyance is stopped for post-processing in the post-processing apparatus 202, it is not necessary to stop or control the conveyance movements of other apparatuses that are coupled in an inline manner. The other apparatuses are the image forming apparatus 100 and the other post-processing apparatuses using the relay unit RU and the finisher FS. Thus, post-processing is performed without affecting the apparatuses on the upstream and downstream sides.

For example, in a case of cutting a leading end of a long sheet in the cross direction, a standby path is preferably provided on the upstream side of the cross-direction cutting unit. For this reason, also in the case in which the post-processing unit is at the downstream part of the apparatus body, the standby path may be arranged on the upstream side of this post-processing unit. Similarly, in the case in which the post-processing unit is at the upstream part of the apparatus body, the standby path may be arranged on the downstream side of this post-processing unit.

Figure 7:
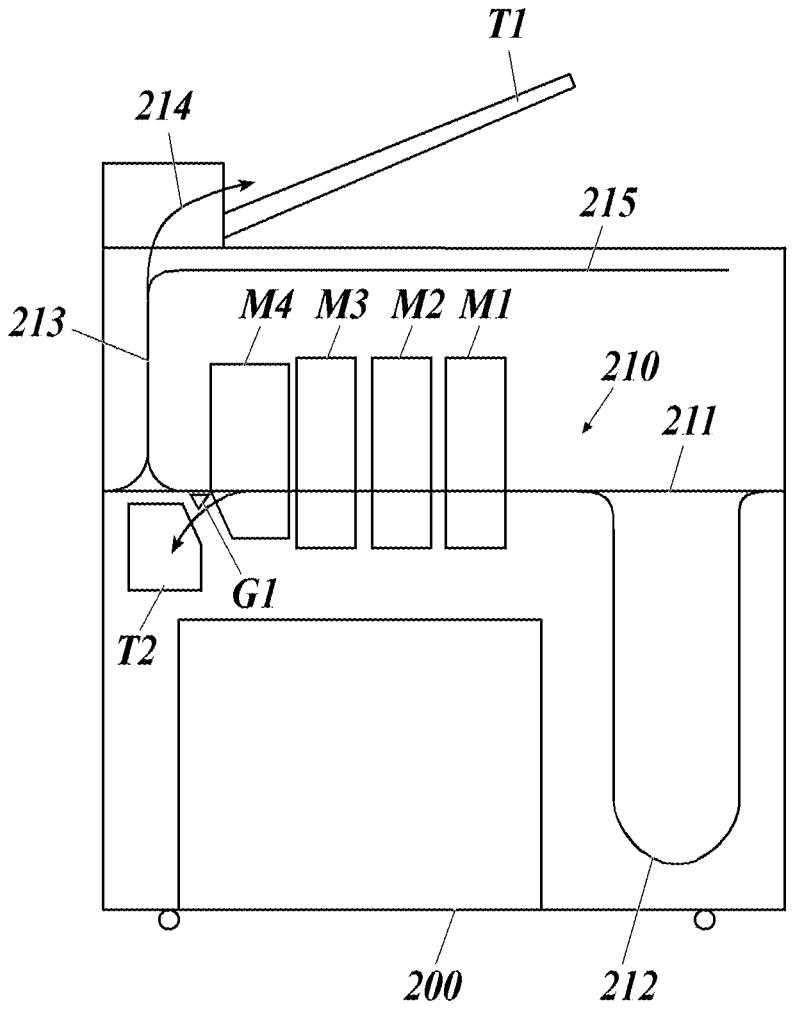
FIG. 7 shows a configuration in which a selection gate for selecting a dedicated tray as a destination of ejected sheets.
Figure 8:
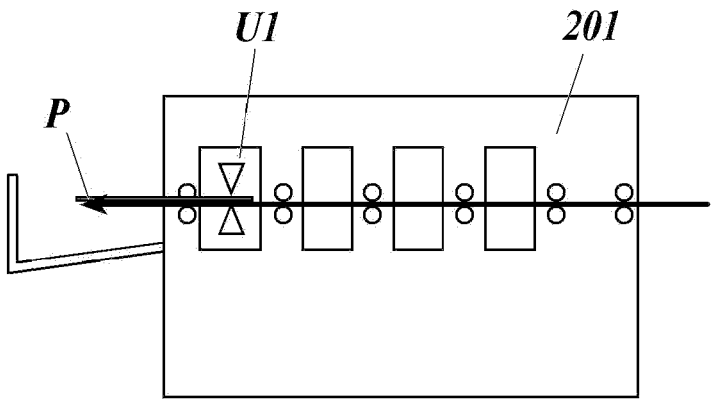
FIG. 8 shows an offline post-processing apparatus of the prior art in an example situation in which post-processing is performed to a sheet that is partly out of the body.
Figure 9:
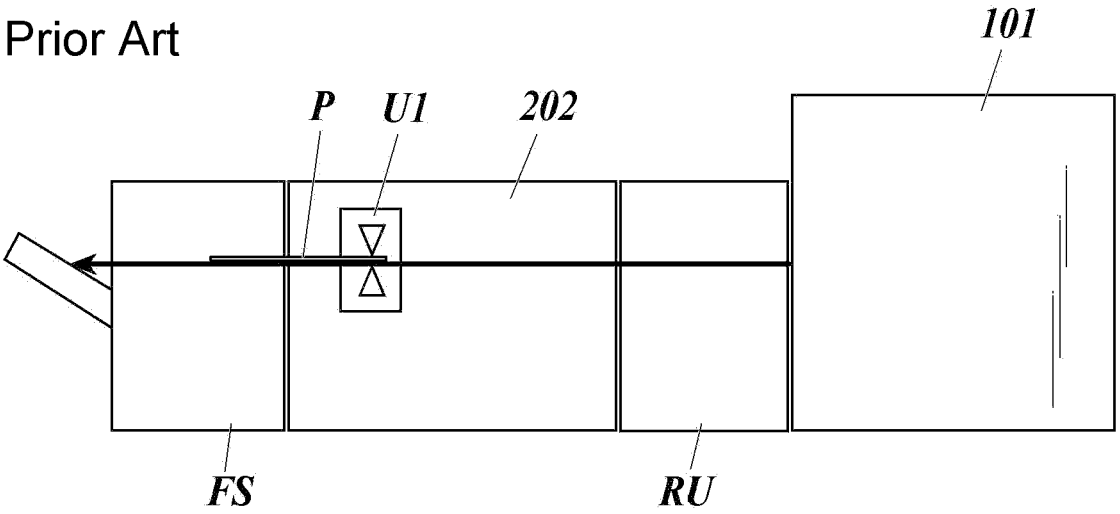
FIG.9 Prior Art
FIG. 9 shows an inline post-processing apparatus of the prior art in an example situation in which a sheet is laid across the post-processing apparatus and another apparatus on the downstream side thereof.

The cross-direction cutting unit, more specifically, the post-processing module M4, may cut a sheet into a size having a feed-direction length that is shorter than the interval or pitch between the conveyance rollers arranged on the downstream side of the cross-direction cutting unit. In this case, a selection gate or a selector G1 for selecting a dedicated tray, such as the card tray T2, as a sheet destination may be provided, as shown in FIG. 7.

In the case in which the cross-direction cutting unit cuts a sheet into a size having a feed-direction length that is shorter than the interval between the conveyance rollers arranged on the downstream side of the cross-direction cutting unit as described above, the provided selection gate or selector G1 for selecting the dedicated tray, such as the card tray T2, as the sheet destination eliminates the need to densely arrange the conveyance rollers for the sheet with the short feed-direction length. Thus, the configuration of the apparatus is simplified.

In addition, details of the structure and movement of each unit or apparatus constituting the image forming system can also be changed and modified without exceeding the scope of the present invention, as necessary.

What is claimed is:

1. A post-processing apparatus configured to be coupled to an image forming apparatus or another post-processing apparatus, the post-processing apparatus comprising:

a post-processing unit that performs post-processing to a sheet that is conveyed; and a standby path arranged on an upstream side or a downstream side of the post-processing unit and capable of holding the sheet, wherein the post-processing unit performs the post-processing in a state in which the sheet is partly in the standby path, wherein the post-processing unit includes a cross-direction cutting unit, and wherein the post-processing apparatus further comprises: a selector that selects a dedicated tray as a sheet destination when the cross-direction cutting unit cuts the sheet into a size having a feed-direction length that is shorter than an interval between conveyance rollers arranged on a downstream side of the cross-direction cutting unit.

2. The post-processing apparatus according to claim 1, wherein the standby path is provided by an inversion path for inverting the sheet.

3. The post-processing apparatus according to claim 2, wherein the inversion path also serves as a purge path for purging the sheet.

4. The post-processing apparatus according to claim 2, wherein the inversion path includes:

a regular-sheet inversion path for inverting the sheet with, at most, a regular size; and a long-sheet inversion path for inverting the sheet with a long size that exceeds the regular size.

5. The post-processing apparatus according to claim 2, wherein the inversion path includes a curved path, and a straight path disposed between the post-processing unit and the curved path.

6. The post-processing apparatus according to claim 5, further comprising: a pressing member that is disposed in the straight path to regulate vertical movement of the sheet.

7. The post-processing apparatus according to claim 2, further comprising: a hardware processor that collates pages of sheets when the inversion path is used.

8. The post-processing apparatus according to claim 1, wherein the standby path is provided by a purge path for purging the sheet.

9. The post-processing apparatus according to claim 1, wherein the standby path is provided by a detour path for the sheet.

10. The post-processing apparatus according to claim 1, wherein the post-processing unit is disposed at an upstream part of the post-processing apparatus, and the standby path is arranged on an upstream side of the post-processing unit.

11. The post-processing apparatus according to claim 1, wherein the post-processing unit is disposed at a downstream part of a body of the post-processing apparatus, and the standby path is arranged on a downstream side of the post-processing unit.

12. An image forming system comprising:

an image forming apparatus that forms an image on a sheet; and the post-processing apparatus according to claim 1 that performs the post-processing to the sheet on which the image is formed by the image forming apparatus.

* * * * *